United States Patent [19]

Tanaka et al.

[11] 4,425,885

[45] Jan. 17, 1984

[54] DIESEL ENGINE FUEL INJECTION DEVICE

[75] Inventors: Toshiaki Tanaka, Fujisawa; Shoji Ushimura, Yokosuka, both of Japan

[73] Assignee: Nissan Motor Company, Limited, Kanagawa, Japan

[21] Appl. No.: 284,466

[22] Filed: Jul. 17, 1981

[30] Foreign Application Priority Data

Jul. 18, 1980 [JP] Japan ..... 55-100685[U]

[51] Int. Cl.[3] ..... F02M 45/02

[52] U.S. Cl. ..... 123/299; 123/446

[58] Field of Search ..... 123/299, 300, 446, 447, 123/387, 496

[56] References Cited

U.S. PATENT DOCUMENTS

| | | | |
|---|---|---|---|
| 2,173,813 | 9/1939 | Bischof | 123/300 |
| 3,392,715 | 7/1968 | Thoma | 123/299 |
| 3,394,891 | 7/1968 | Voit | 123/299 |
| 3,627,208 | 12/1971 | Scott et al. | 123/459 |
| 3,752,137 | 8/1973 | Kimberley | 123/299 |
| 4,201,160 | 5/1980 | Fenne | 123/300 |
| 4,259,040 | 3/1981 | Scheying | 123/300 |
| 4,289,098 | 9/1981 | Norberg et al. | 123/299 |
| 4,333,434 | 6/1982 | Brunais et al. | 123/299 |

*Primary Examiner*—Charles J. Myhre
*Assistant Examiner*—Magdalen Moy
*Attorney, Agent, or Firm*—Lowe, King, Price & Becker

[57] ABSTRACT

A fuel supply control device is disclosed wherein, as pressure of fuel from a fuel injection pump increases, a piston responsive to fuel pressure temporarily reduces or shuts off initial flow of fuel from the pump to a fuel injector through a series of fuel passageways. A second piston may be provided in a passageway to control movement of the first piston such that when the engine operates under relatively low loads at low speed, the second piston causes the first piston to restrict fuel flow. When the engine operates at relatively high speeds and high loads, the second piston cooperates with the first piston to feed fuel to the injector at high pressure.

10 Claims, 8 Drawing Figures

DIESEL ENGINE FUEL INJECTION DEVICE

BACKGROUND OF THE INVENTION

This invention relates to a fuel injection device for use with a diesel engine, and more particularly to a fuel supply control device for use with a fuel injection pump of the diesel engine.

Conventional fuel injection pumps control the amount of fuel injected into the engine as a function of engine load. Characteristic of such pumps are; relatively high initial fuel injection rates, causing production of $NO_x$-rich exhaust gas at high noise levels.

SUMMARY OF THE INVENTION

It is therefore an object of the present invention to provide a fuel supply control device for use with a fuel injection pump to reduce $NO_x$ component in exhaust gas as well as noise by using a reduced initial fuel injection rate for a relatively large part of the piston stroke.

A fuel supply control device, for use with a fuel injection pump of a diesel engine, according to this invention serves to reduce the initial fuel injection rate from the pump when the initial fuel injection rate is relatively large and then recovers the injection rate later in the piston stroke, thereby reducing the $NO_x$ component in exhaust gas, and noise.

BRIEF DESCRIPTION OF THE DRAWINGS

Other objects, features, and advantages of this invention will be apparent from the following description of a preferred embodiment thereof, taken in conjunction with the accompanying drawings in which the same reference numerals designate corresponding elements or parts throughout the drawings and in which.

DETAILED DESCRIPTION OF THE PREFERRED EMBODIMENTS

Figure 1:
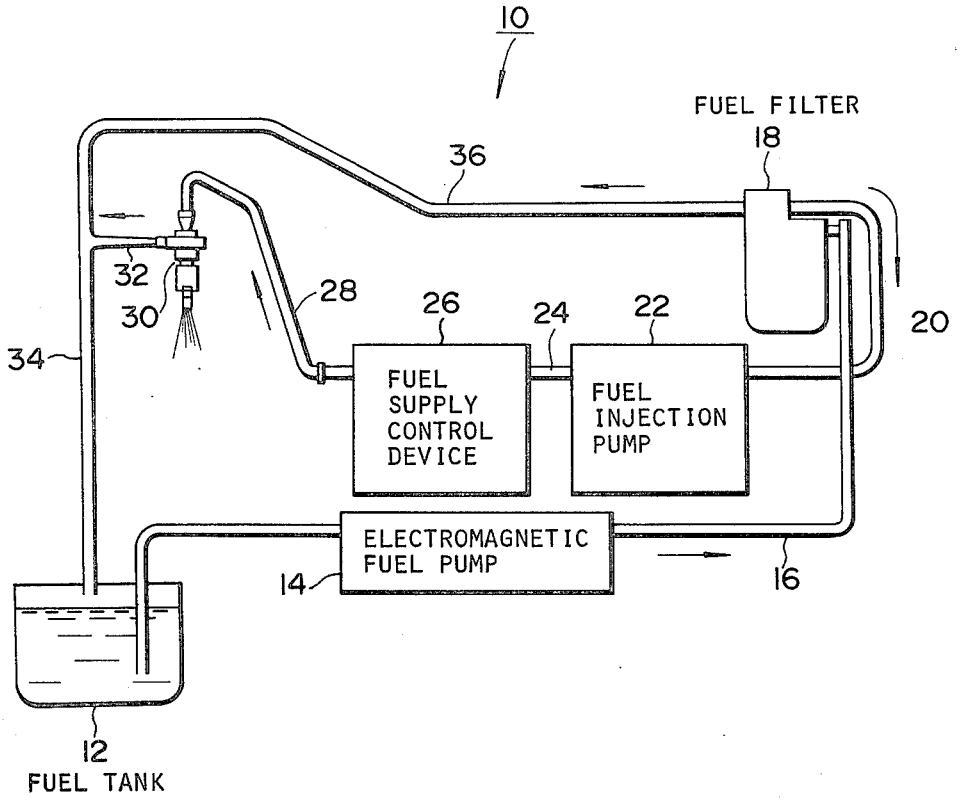
FIG. 1 is a diagramatic view showing a fuel supply system in which a fuel supply control device according to this invention is incorporated.

In FIG. 1, there is shown a fuel supply system, generally designated by reference numeral 10, in which a fuel supply control device according to this invention is incorporated. Fuel is fed at a constant flow rate from a fuel tank 12 by an electromagnetic fuel pump 14 through a pipe 16 to a fuel filter 18 and thence through a pipe 20 to a fuel injection pump 22 of well-known design which acts to control the amount of fuel supplied through a pipe 24 to one of plural fuel supply control devices 26 according to this invention, in such a manner that the amount of fuel fed from pump 22 increases with engine load. Injection pump 22 has a relatively large initial injection rate. Fuel from control device 26, which will be described hereinafter in more detail, is fed through a pipe 28 to an injector 30 from which fuel is injected into the diesel engine (not shown). Combustion occurs when pressure of fuel from control device 26 increases beyond a predetermined value to operate injector 30. The remaining fuel not used by injector 30 returns through pipes 32 and 34 to tank 12. Remaining fuel not used by fuel injection pump 22 also returns to tank through filter 18, a pipe 36 and pipe 34.

Figure 2:
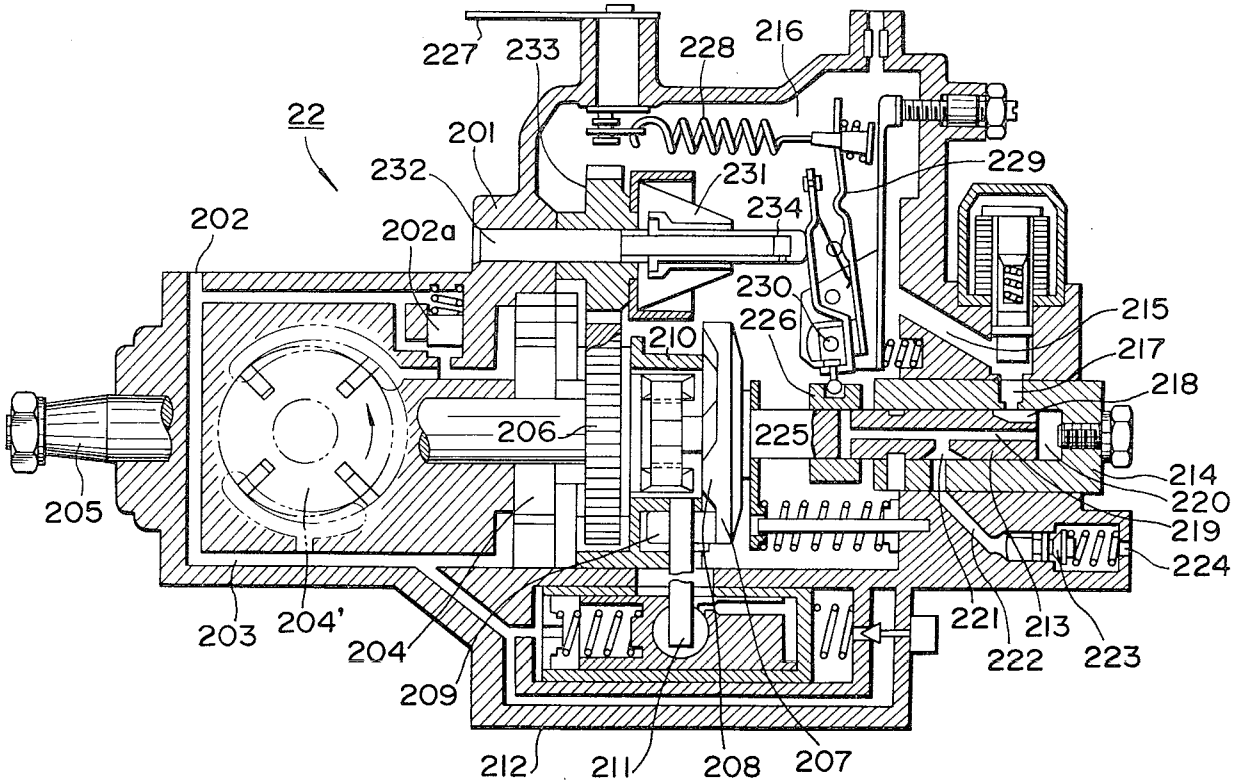
FIG. 2 (PRIOR ART)
FIG. 2 is a cross-sectional view of the fuel injection pump used in the system of FIG. 1.

FIG. 2 is a detailed illustration of fuel injection pump 22. A pump housing 201 is provided with a fuel inlet 202 which introduces fuel from pipe 20 to a fuel passageway 203. A pre-compressor vane pump 204 is driven by a drive shaft 205 which in turn is driven by the engine crankshaft (not shown). A regulating valve **202*a* regulates pressure of fuel fed from pump 204 to a chamber 216. Drive shaft 205 has a gear 206 attached thereto. A cam disc 207 is mounted for axially sliding movement relative to shaft 205 and is rotatable together with gear 206. Cam disc 207 regulates the phases of the fuel injection timing. Toward this end, the flange surface of cam disc 207 has the same number of symmetrically-arranged cams 208 as the engine has cylinders (not shown). The cam surfaces can be brought into contact with rollers 209 rotatably supported within a cylindrical member 210. The member 210 is supported coaxially with drive shaft 205 and rotates about the shaft axis relative to cam disc 207 by an angle corresponding to the pressure of fuel within the housing by way of a connecting rod 211 of a timing device 212 of well-known design. A plunger 213 is secured at one end to cam disc 207 and its free end is axially-movably received in a cylinder 214. A fuel inlet passageway 215 conducts fuel from chamber 216 to an intake port 217 provided in cylinder 214. The plunger 213 is provided with the same number of grooves 218 as the engine has cylinders and each groove is sequentially communicable with inlet port 217 as the plunger rotates. Plunger 213 is also provided with an axially-extending fuel delivery passage 219 formed therewithin which communicates through grooves 218 with a high-pressure chamber 220 formed by cylinder 214 and the plunger. A distributor port 221 is formed in the outer surface of plunger 213, and communicates with fuel delivery passageway 219. The distributor port 221 can sequentially align with each of the same number of output passages 222 as the engine has cylinders. Each output passage 222 communicates through the corresponding cutoff valve 223 and outlet 224 to the corresponding fuel supply control device 26. Cut-off valves 223 prevent output of fuel at pressures that are not significantly greater than the pressure within housing 216. Thus, when a cut-off port 224 provided in plunger 213 slides out of a control sleeve 226, fuel pressure in the plunger decreases so that no fuel is delivered through the cut-off valve 223. This control sleeve 226 is operated by movement of the accelerator (not shown) transmitted through a lever 227, a spring 228, and a link mechanism 229: when the accelerator is depressed, i.e. when the spring 228 is pulled to the left, the link mechanism 229 rotate counterclockwise about a pivot 230, thereby blocking the cut-off port 225 with the control sleeve 226, thereby increasing the fuel pressure at the distributor port 221 and therefore increasing the amount of fuel supplied to any of the control devices 26. A centrifugal governor 231 is provided on a governor shaft 232. When the pump speed increases, the rotational speed of the drive gear 206 connected to shaft 205 increases, which causes the rotational speed of a gear 233 meshing with the gear 206. As the vanes of the governor 231 swing out, a sleeve 234 fitted slidably over the shaft 232 slides to the right in FIG. 2, thereby turning the link mechanism 229 clockwise about pivot 230 which opens cutoff port 225. This reduces the supply of fuel to device 26, thereby maintaining the rotational speed of the engine, and therefore feed pump 204**, at a substantially constant value.

In FIG. 2, in order to show the lines of the vane pump 204 shown in solid lines in the side view, the cross-section of the vane pump 204 is shown at 204' rotated through 90 degrees. Similarly, to simplify matters, the starter timer 212 is shown rotated through 90 degrees.

Fuel entering the fuel injection pump 22 is precompressed by vane pump 204 and is then fed through chamber 216 and passage 215 to intake port 217. Plunger 213 is rotated by shaft 205 and is reciprocated by cam disc 207, and fuel enters high pressure chamber 220 through intake groove 218 when one of the grooves aligns with inlet port 217. In high-pressure chamber 220, the fuel is compressed by the action of cam disc 207 and therefore plunger 213, and fed to distributor port 221. Fuel is then forced under pressure by way of one of output passages 222 aligning with port 221 and corresponding delivery valve 223, through outlet 224 to control valve 26 (in FIG. 1).

However, in this injection pump, since cam disc 207 and plunger 213 are designed to have a predetermined profile, it is impossible to alter the profile of the cam disc and the plunger shape according to changes in the engine's operating conditions, in order to satisfy the injection requirements at low engine loads as well as at high loads. Thus the injection quantity is normally set on the high side, so that if this type of mechanism were used by being directly connected to injector 30, the fuel injection rate (quantity of fuel injected/period of injection) would be too large at the beginning of the piston stroke. The fuel injection rate at the start of the injection would rise abruptly, the quantity of $NO_x$ exhaust gases would be large, and noise levels would also be high—all of which, however, can be rectified by provision of the fuel supply control device 26 according to this invention.

Figure 3:
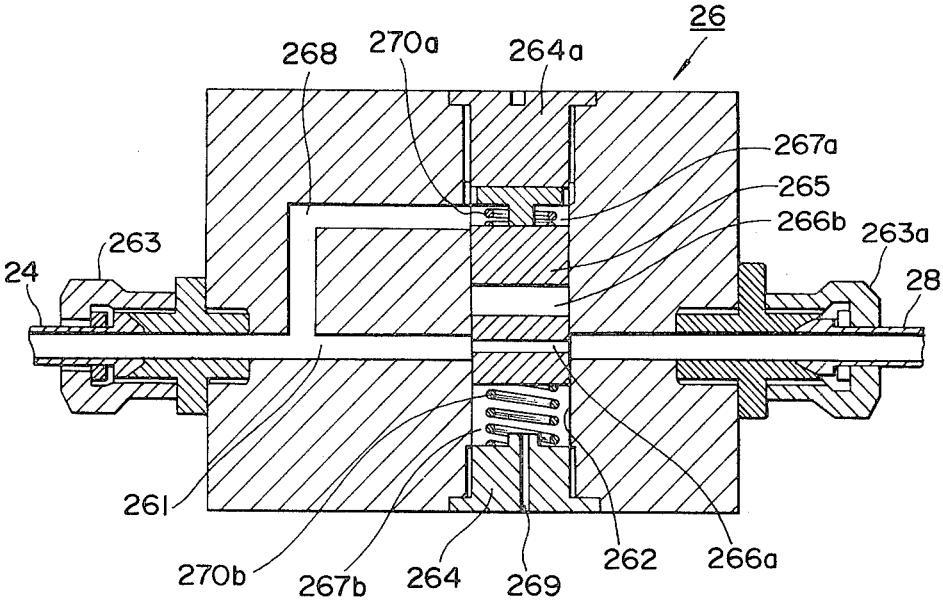
FIG. 3 is a cross-sectional view of the preferred embodiment of the fuel supply control device according to this invention.

FIG. 3 is a cross-sectional view of the preferred embodiment of the fuel supply conrol device 26. Device 26 may take the form of a switching valve having a fuel passageway 261 formed generally transversely to a bore 262. Passageway 21 communicates through a fuel inlet 263 by way of pipe 24 with pump 22. At either end of bore 262, stops 264 and **264*a* are formed. Stops 264, 264*a* also serve as oil seals at either end of the bore. A piston 265 reciprocates in the bore 262 between oilseals 264, 264*a*. Fuel passageways 266*a* and 266*b* of pre-determined cross-sectional area are formed through piston 265, and when either passage is aligned with the fuel passageway 261, fuel is supplied to injector 30 through fuel output 263*a* and pipe 28**.

Chambers **267*a* and 267*b* are formed between each of stops 264 and 264*a* and piston 265. Chamber 267*a* is supplied with fuel under pressure by an actuation passage 268 communicating with passage 261. Chamber 267*b* is supplied with substantially constant reference pressure such as fuel under pressure from pump chamber 216 through a passage 269. In FIG. 3, pressure actuation chamber 267*a* and chamber 267*b* contain springs 270*a* and 270*b* respectively. Spring 270*b* is stronger than spring 270*a* to the degree that when fuel pressure in chamber 267*a* is at its lowest value, passageways 261 and 266*a*** are aligned.

In operation, the fuel pressure begins to rise due to working of the fuel pump 22 (in FIG. 1), and the pressure within pump chamber 216 rises with the passage of fuel through actuation passageway 268. In this manner, a pressure difference is gradually created between fuel pressure actuation chamber **267*a* and base-pressure chamber 267*b*, and piston 265 moves downward against the resistance of spring 270*b*. As a result, the area of coincidence of the fuel passageways 261 and 266*a* is decreased, but shortly after fuel starts being injected from injector 30, the connection between fuel passageways 261 and 266*a* is broken. The fuel passageways 261 and 266*a* are isolated from one another, but as plunger 213 continues its compression stroke, the fuel pressure in fuel passageway 261 and, hence, the fuel pressure actuation chamber 267*a*, increases. Eventually, the fuel passageway 266*a* is brought into alignment with fuel passageway 261, and fuel injection from injector 30** is immediately recommenced.

In the decompression stroke of plunger 213, cut-off port 225 opens to chamber 216, and therefore, at this time the fuel pressure difference between fuel pressure actuation chamber **267*a* and base pressure chamber 267*b* equalizes and piston 265 is moved upwards in response to the spring constants and lengths of springs 270*a*, 270*b* The function of stops 264*a* and 264*b* is to determine the limiting positions of piston 265 and therefore the fuel passageways 266*a* and 266*b***.

Figure 4:
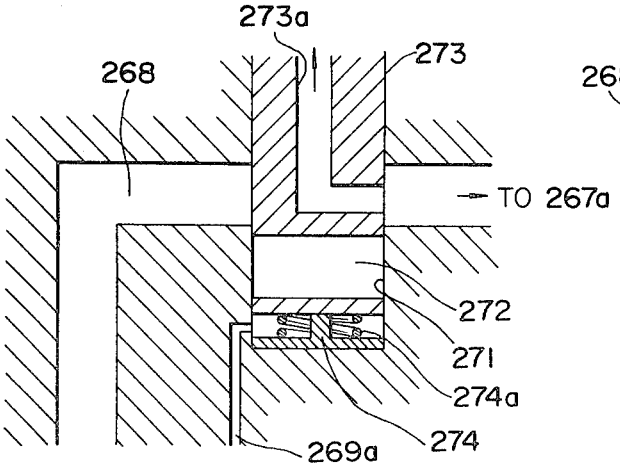
FIG. 4 shows a part of a modification of the device of FIG. 3 in cross-section.

FIG. 4 shows a modification of the present invention, showing a cutoff shaft 273 or piston provided within a bore 271 intersecting actuation passageway 268 similar to the one of FIG. 3 in order to suspend the function of control device 26 according to the state of the engine operation. The remaining structure of the device is the same as that of the device of FIG. 3. When the engine is lightly loaded at a low speed, an electromagnetic valve (not shown) switches off to lift cutoff shaft 273, and actuation passageway 268 then communicates with the fuel pressure actuation chamber **267*a* (FIG. 3) by passageway 272, causing a two-stage fuel injection similar to the injection described in the structure of FIG. 3. During all other engine operating conditions the electromagnetic valve is then switched on, lowering cutoff shaft 273; fuel passageway 268 is thus closed so that fuel cannot enter fuel pressure actuation chamber 267*a*, causing fuel to flow unhindered through control device 26 to injector 30. In FIG. 4, a passageway 273*a* communicates with pump chamber 216 of FIG. 2, and a stop 274 installed on the bottom of bore 271 is provided with a spring 274*a* biasing cutoff shaft 273 upwards. Reference pressure such as fuel pressure on the intake side of pump 26 or atmospheric pressure is admitted to the space below piston 273 through a passageway 269*a***.

Figure 5:
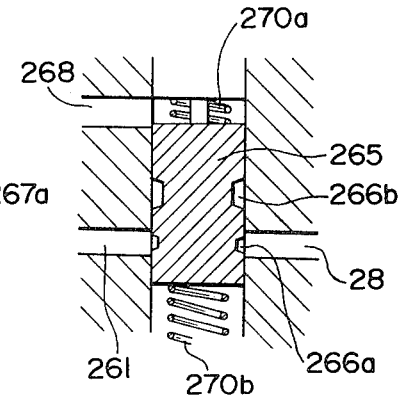
FIG. 5 is a view, similar to FIG. 4, of a part of a second modification of the device of FIG. 3.

In FIG. 5, a modification of the piston shown in FIG. 3 is illustrated. In this modification, fuel passageways **266*a* and 266*b* are formed as annular grooves in the outer surface of piston 265 so that they can each communicate with fuel passageway 261**.

Figure 6:
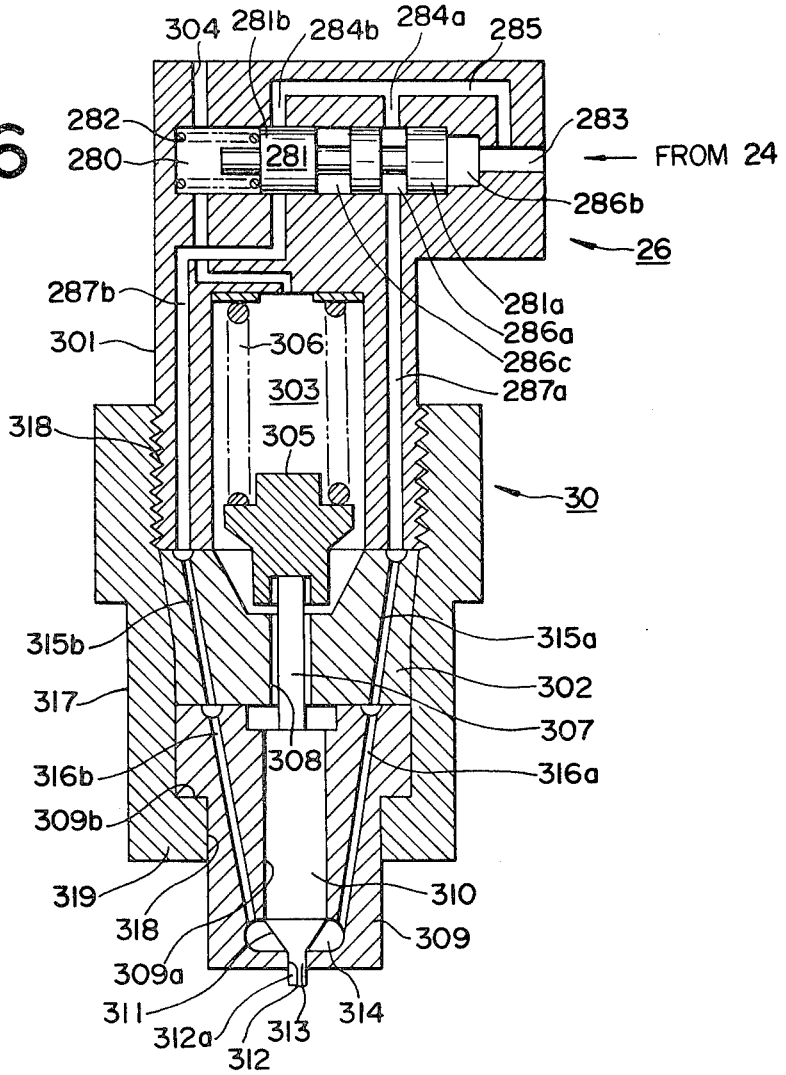
FIG. 6 is a modification of the invention including integral formation of a fuel supply control device and an injector.

In FIG. 6, a further modification of the present invention includes integral formation of a fuel supply control device 26 and an injector 30. Control device 26 includes a bore 280 in which is movably disposed a piston 281 which is normally urged by a biasing means 282 to the right in FIG. 6 against an inlet 283 of the control device. The control device includes two branch passageways 284*a* and 284*b* in its body, both communicating with the inlet 283 through a passageway 285. Branch passageway 284*a* communicates through an annular groove 286*a* provided on piston 281 with a passageway 287*a* provided in device 26, whereas branch 284*b* is normally blocked by piston land 281*b* so that it cannot communicate with a passage 287*b* provided in the device. If piston 281 moves to the left passage 284*a* is at first blocked by piston land 281*a* and then branches 284*a*, 284*b* are simultaneously connected through annular grooves 286*b* and 286*b* with passageways 287*a*, 287*b*, respectively. Injector 30 includes an upper part 301 integral with the device 26 and an intermediate member 302 cooperating to form a cavity 303 which communicates with atmosphere through a passage 304 provided in the body through bore 280. Disposed in the cavity 303 is a seat 305 which is normally biased downward by a spring 306 disposed between the upper end of the cavity and the seat member. Seat member 305 has a rod 307 screwed thereinto that extends movably through a bore 308 within intermediate member 302. A lower; member 309 includes a bore 309*a* in which a needle valve 310 is vertically movably received. The needle valve is securely connected to the lower end of the rod 307 and has a tapered portion 311 ending in a needle 312 which protrudes through a nozzle 313 in lower member 309. A groove 312*a* is formed on the needle 312. The upper part 301, the intermediate member 302, and the lower member 309 have the passageways 287*a*, 287*b*; 315*a*, 315*b*; and 316*a*, 316*b*. respectively, extending therethrough. The passageways 287*a*, 315*a*, and 316*a* form a fuel passageway leading to the cavity 314 and the passageways 287*b*, 315*b* and 316*b* forms another fuel passageway leading to the cavity 314. The upper part 301, the intermediate member 302, and the lower member 309 are sealingly held together, in the serial order mentioned and arranged so that the fuel passageways mentioned above are aligned as described, by a jacket 317 in the form of a radially-symmetrical shell. One end of the jacket 317 is threaded on the inside to match threads provided on the lower portion of the upper part 301. The other end has a flange 319 which serves to restrain a shoulder 309*b* formed on the lower member 309.

During initial injection, fuel entering inlet 283 from passageway 24 (FIG. 1) flows through passageway 285, branch passageway 284*a*, and groove 286*a*. As pressure of fuel increases, piston 281 moves to left against return spring 282. Communication between branch passageway 284*a* and passageway 287*a* is then blocked by land 281*a* so that fuel pressure at inlet 283 abruptly increases. Thus, at the moment when passages 284*a* and 284*b* communicate with passages 287*a* and 287*b*, a large amount of fuel is forced through the pair of passageways constituted by the passageways 287*a*, 315*a*, 316*a* and 287*b*, 315*b*, 316*b*, so that needle valve 310 is lifted, thereby causing fuel to be injected through nozzle 313 outward into the engine cylinder.

Figure 7:
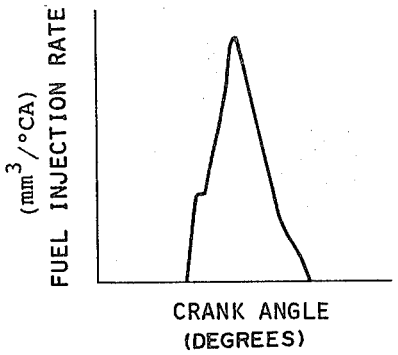
FIG. 7 is a graph showing the injection rate characteristics of the system of FIG. 1 with the fuel supply control device removed.
Figure 8:
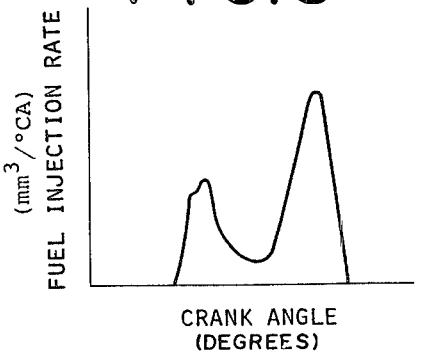
FIG. 8 is a graph, similar to FIG. 7, of the system of FIG. 1 incorporating the fuel supply control device according to this invention being provided.

FIGS. 7 and 8 show the injection patterns of the system without and with device 26, respectively.

While this invention has been described and shown with respect to a preferred embodiment and modifications thereof, various changes and modifications thereof could be made by those skilled in the art without departing from the spirit and scope of this invention.

What is claimed is:

1. A fuel supply control device for use with a fuel injection pump of a diesel engine, comprising:

(a) means defining a first fuel passageway and a first bore intersecting said first passageway;

(b) a first piston member slidably disposed within the first bore, said piston having second and third fuel passageways;

(c) means biasing the piston member in a first direction to permit alignment of said first and second passageways with each other to allow fuel flow therethrough when fuel pressure is lower than a predetermined value; and (d) a fourth passageway for admitting fuel from said first fuel passageway to one end of the piston member within the first bore to enable fuel pressure in said first passageway to act against the piston-biasing means to move the second passageway via piston movement in a direction opposite the first direction out of alignment with said first passageway as fuel pressure increases through a predetermined range to thereby block fuel flow through the the second passageway and to enable the third passageway to move into alignment with said first passageway to permit fuel flow therethrough, said first piston being movable in the first direction to realign the first and second passageways as fuel pressure decreases from its highest value, whereby fuel flow through said device is varied as a function of fuel pressure in the first passageway.

2. The fuel supply control device of claim 1, further including means for admitting a predetermined reference fluid pressure to the end of the piston member opposite said one end communicating with the fourth passageway.

3. The fuel supply control device of claim 2, wherein the first bore and the piston member enclosed therein cooperate to form a space at each end of the piston member, one space accommodating fluid pressure from the fourth passageway and the other space communicating with the predetermined reference pressure.

4. The fuel supply control device of claim 1 further including a second bore intersecting the fourth passage, a second piston slidably disposed within the second bore, said second piston having a fifth passageway and a sixth passageway, said second piston being positioned to permit alignment between said fourth passageway and the sixth passageway to permit flow of a fluid at a predetermined reference pressure to said one end of said first piston, said second piston being further movable to permit alignment between the fourth passageway and the fifth passageway when said engine is under light load conditions at low speed and means for biasing said second piston so that said fourth passageway and the fifth passageway are aligned to permit fuel flow through the second bore.

5. The fuel supply control device of claim 3, wherein the second and third passageways extend diametrically through the first piston.

6. The fuel supply control device of claim 3, wherein the second and third passageways extend along the outer surface of the first piston.

7. The fuel supply control device of claim 1, further including a fifth passageway intersecting the first bore, said first piston member having a sixth passageway alignable with the fifth passageway such that when fuel pressure increases through a predetermined range, the first passageway initially moves out of alignment with the second passageway and into alignment with the third passageway simultaneously with alignment between the fifth and sixth passageways and a fuel injector, both the first and fifth passageways leading to the injector.

8. The fuel supply control device of claim 7, wherein said injector is formed integral with the fuel supply control device, said injector including means defining a second bore having an opening, a needle valve slidably disposed in the second bore, means for biasing the needle valve so that an end of the needle valve normally blocks the bore opening, seventh and eighth fuel passageways each communicating at one end thereof with the first and fifth passageways respectively and at opposite ends thereof with an outer surface of the needle valve so that when fuel flows through the seventh and eighth passageways, fuel pressure in said seventh and eighth passageways cooperate to exert pressure on the needle valve against the biasing means to move the needle valve away from the bore opening, thereby injecting fuel from the bore opening.

9. The fuel supply control device of claim 8, wherein said injector comprises a first body formed integral with the means defining the first bore, a second body contacting the first body and cooperating to form a cavity, said second body having a third bore through which a part of the needle valve extends, the needle valve biasing means including a seat member engaging with an end of said part of the needle valve and spring means enclosed in the cavity biasing the seat member against the needle valve, a third body contacting the second body and including said second bore in which the remaining portion of the needle valve is axially movable, said second bore having a large cavity relative to the second bore diameter formed near the bore opening, the needle valve having a tapered portion located in the large cavity, and wherein said seventh and eighth passages extend through the first, second and third bodies to communicate with the large cavity.

10. The fuel supply control device of claim 9, wherein said third body has a shoulder and said device includes means for retaining the first, second and third bodies together, said retaining means including a hollow cylindrical jacket member having a flange at one end to engage and retain the third body at its shoulder while enabling a portion of the third body containing said bore opening to project outwardly through said flange, said first body having a peripheral threaded portion thereon engageable with an interior threaded portion of the jacket to enable the jacket to retain the first body, the third body and the second body retained between the first and third bodies in secure alignment therebetween.

* * * * *